US008561507B2

(12) United States Patent
Huang

(10) Patent No.: US 8,561,507 B2
(45) Date of Patent: Oct. 22, 2013

(54) SCREWDRIVER

(76) Inventor: Yung-Hsu Huang, Taichung (TW)

( * ) Notice: Subject to any disclaimer, the term of this patent is extended or adjusted under 35 U.S.C. 154(b) by 245 days.

(21) Appl. No.: 13/214,246

(22) Filed: Aug. 22, 2011

(65) Prior Publication Data

US 2013/0047795 A1 Feb. 28, 2013

(51) Int. Cl.
*B25B 23/16* (2006.01)
*B25G 1/08* (2006.01)

(52) U.S. Cl.
USPC ..... 81/438; 81/177.4; 81/490

(58) Field of Classification Search
USPC ..... 81/438, 439, 440, 177.4, 490
See application file for complete search history.

(56) References Cited

U.S. PATENT DOCUMENTS

| | | | | |
|---|---|---|---|---|
| 6,032,332 | A * | 3/2000 | Lin | 16/111.1 |
| 6,742,421 | B1 * | 6/2004 | Chen | 81/490 |
| 7,174,814 | B2 * | 2/2007 | Liao | 81/177.4 |
| 2004/0112187 | A1 * | 6/2004 | Chen | 81/490 |
| 2005/0284267 | A1 * | 12/2005 | Liao | 81/177.4 |

* cited by examiner

*Primary Examiner* — David B Thomas

(57) ABSTRACT

A screwdriver contains a front part including a connector and a number of ribs, between each two ribs being defined a chamber; a middle part including a central block and a plurality of extending wings, the central block including an orifice, each extending wing including a slot; a rear part including a cover, a shaft, and a plurality of pegs; a plurality of seats axially connected between the two extending wings and the two pegs and located at the chamber of the front part, and each seat being moved between a storing position and an operating position by an external force; a number of bits, each including one end to be inserted into the seat when the screwdriver is operated, the seat is moved toward an operating positions so that another end of the seats extends out of the chamber of the front part to take out a desired bit.

10 Claims, 7 Drawing Sheets

SCREWDRIVER

BACKGROUND OF THE INVENTION

1. Field of the Invention

The present invention relates to a screwdriver in which bits are capable of being taken out quickly.

2. Description of the Prior Art

A conventional screwdriver includes a plurality of bits formed in different shapes, such as a cross, a tetragon, a hexagon, a star so that the bits are fitted onto or removed from the screwdriver based on different requirements.

However, the bits have to be stored in a box to occupy a store space. In addition, the box and the screwdriver are put separately to lose easily, and the bits have to be taken out of the box to be further fitted on the screwdriver, increasing replacement time.

The present invention has arisen to mitigate and/or obviate the afore-described disadvantages.

SUMMARY OF THE INVENTION

The primary object of the present invention is to provide a screwdriver that in which various bits are capable of being taken out and replaced quickly.

Another object of the present invention is to provide a screwdriver in which various bits are stored in the screwdriver to save a store space.

To obtain the above objective, a screwdriver provided by the present invention contains:

a front part including a connector disposed on one end thereof and a number of ribs axially extending on another end thereof, between each two ribs being defined a chamber;

a middle part including a central block and a plurality of extending wings extending around the central block, the central block including an orifice, each extending wing including a slot formed on an outer side thereof to slide the sliding projection;

a rear part including a cover, a shaft, and a plurality of pegs; a free end of the shaft of the rear part is inserted into the orifice of the middle part, and the pegs contact with the ribs of the front part;

a plurality of seats axially connected between the two extending wings and the two pegs and located at the chamber of the front part, and each seat being moved between a storing position and an operating position by an external force;

a number of bits, each including one end to be inserted into the seat when the screwdriver is operated, the seat is moved toward an operating positions so that another end of the seats extends out of the chamber of the front part to take out a desired bit.

DETAILED DESCRIPTION OF THE PREFERRED EMBODIMENTS

Figure 1:
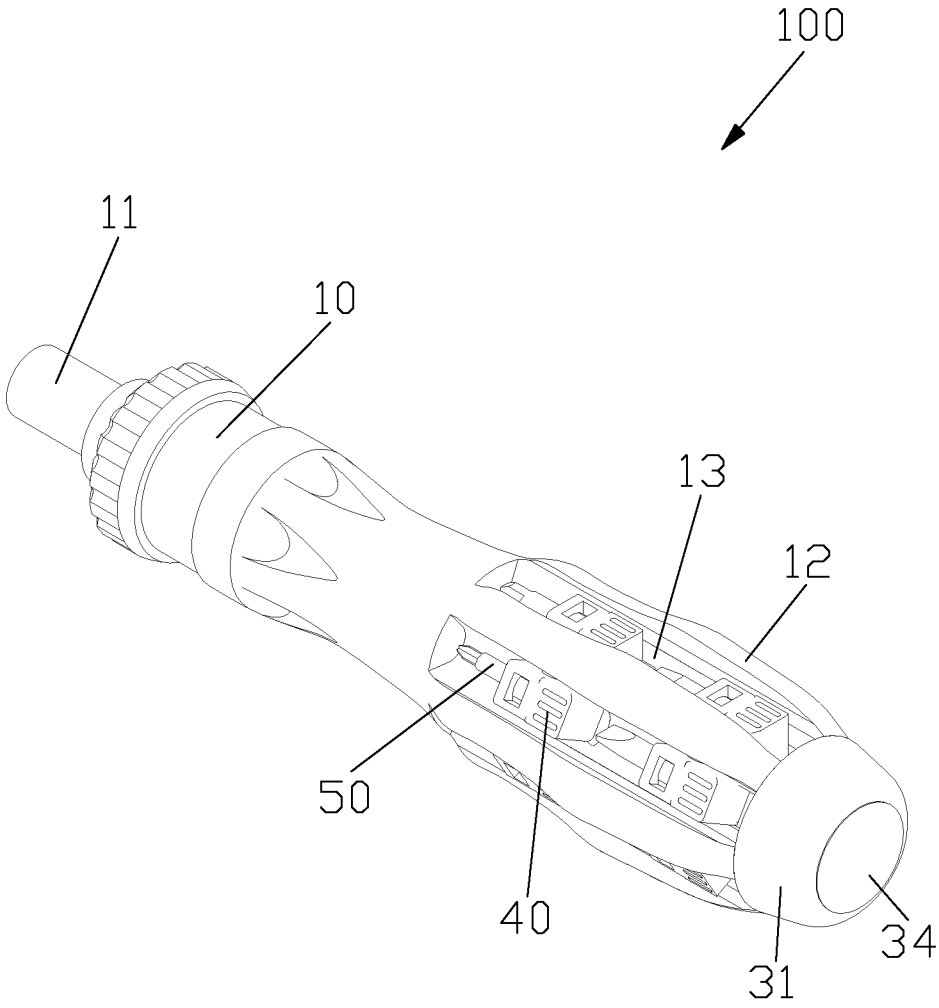
FIG. 1 is a perspective view showing the assembly of a screwdriver according to a preferred embodiment of the present invention.

The present invention will be clearer from the following description when viewed together with the accompanying drawings, which show, for purpose of illustrations only, the preferred embodiment in accordance with the present invention.

Referring to FIGS. 1-7, a screwdriver 100 in accordance with a first embodiment of the present invention comprises a front part 10, a middle part 20, a rear part 30, a plurality of seats 40, and a number of bits 50.

Figure 2:
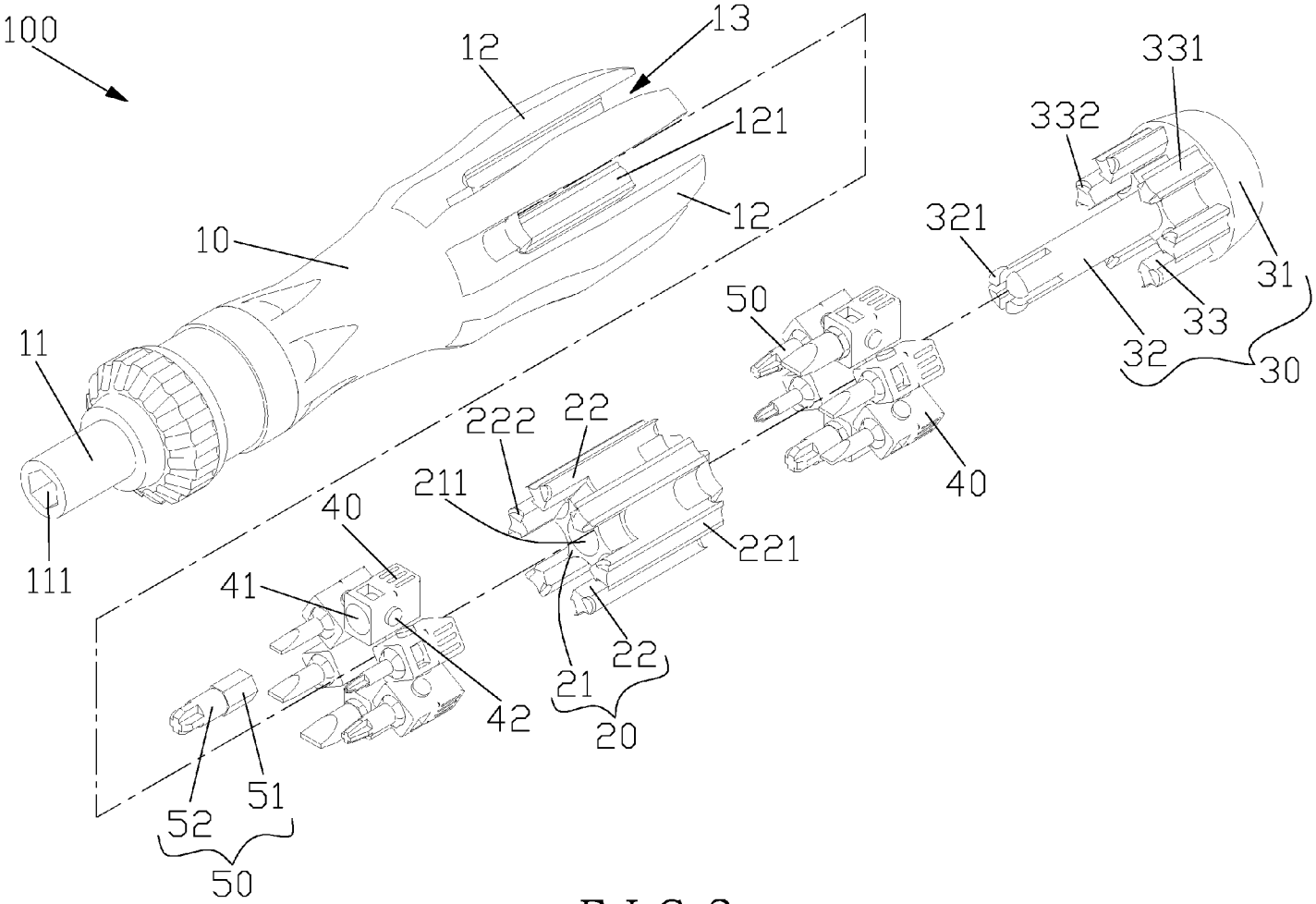
FIG. 2 is a perspective view showing the exploded components of the screwdriver according to the preferred embodiment of the present invention.

As show in FIGS. 1 and 2, the front part 10 includes a connector 11 disposed on one end thereof, the connector 11 includes a hexagonal hole 111 to fit the bits, and the front part 10 includes a number of ribs 12 axially extending on another end thereof and spaded apart from each other equally, between each two ribs 12 is defined a chamber 13, and each rib 12 includes a sliding projection 121 extending outward from an inner side thereof.

As illustrated in FIGS. 1 and 2, the Middle part 20 includes a central block 21 and a plurality of extending wings 22 extending around the central block 21, the central block 21 includes an orifice 211, each extending wing 22 includes a slot 221 formed on an outer side thereof to slide the sliding projection 121 so that the middle part 20 is surrounded by the ribs 12. Each extending wing 22 includes two recesses 222 arranged on two opposite sides thereof respectively.

With reference to FIGS. 1 and 2, the rear part 30 includes a cover 31, a shaft 32, a plurality of pegs 33, and a rotary lid 34; the shaft 32 integrally extends from a front end of the cover 31 and includes a number of paws 321 disposed on a free end thereof, the pegs 33 integrally extend around the shaft 32 of the front end of the cover 31, and each peg 33 includes a first cutout 331 disposed on an outer surface thereof and two second cutouts 332 fixed on two sides thereof individually, the rotary lid 34 is secured on a rear end of the cover 31 and is capable of rotating relative to the cover 31; the free end of the shaft 32 of the rear part 30 is inserted into the orifice 211 of the central block 21, and the paws 321 retain with orifice 211 of the central block 21 so that the rear part 30 is connected with the middle part 20, and the sliding projections 121 of ribs 12 slide in the first cutouts 331 of the rear part 30 respectively.

As shown in FIGS. 1 and 2, each seat 40 includes a notch 41 formed on one end thereof and two pillars 42 arranged on two opposite sides thereof respectively so that the seat 40 is axially coupled with the two recesses 222 of the extending wing 22 of the middle part 20 and the two second cutouts 332 of the peg 33 of the rear part 30 so that the seat 40 is axially connected between the extending wing 22 and the peg 33 and is located at the chamber 13 of the front part 10, and the seat 40 is moved between a storing position and an operating position by an external force.

As illustrated in FIGS. 1 and 2, each bit 50 includes a hexagonal insertion 51 disposed on one end thereof and an acting segment 52 formed in different shapes and fixed on another end thereof, the insertion 51 of the bit 50 is formed in a cross, a start, a cone, a hexagon, and a tetragon shape to insert into the notch 41 of the seat 40.

Figure 3:
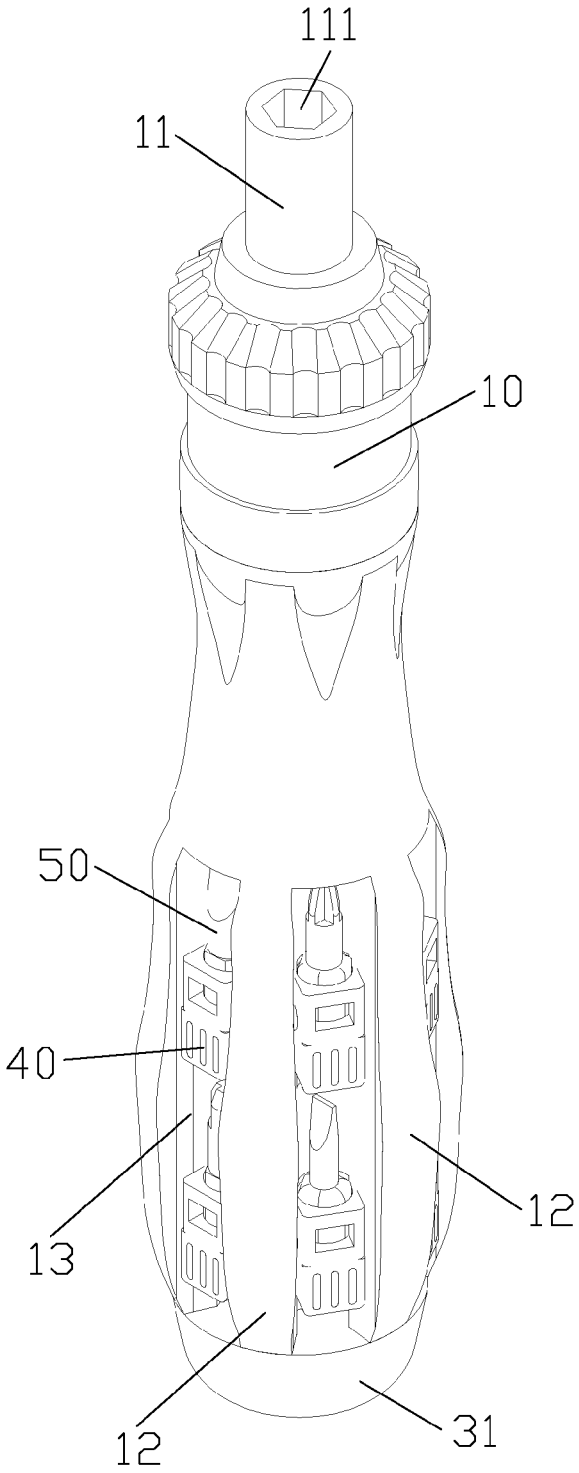
FIG. 3 is a perspective view showing the operation of the screwdriver according to the preferred embodiment of the present invention.
Figure 4:
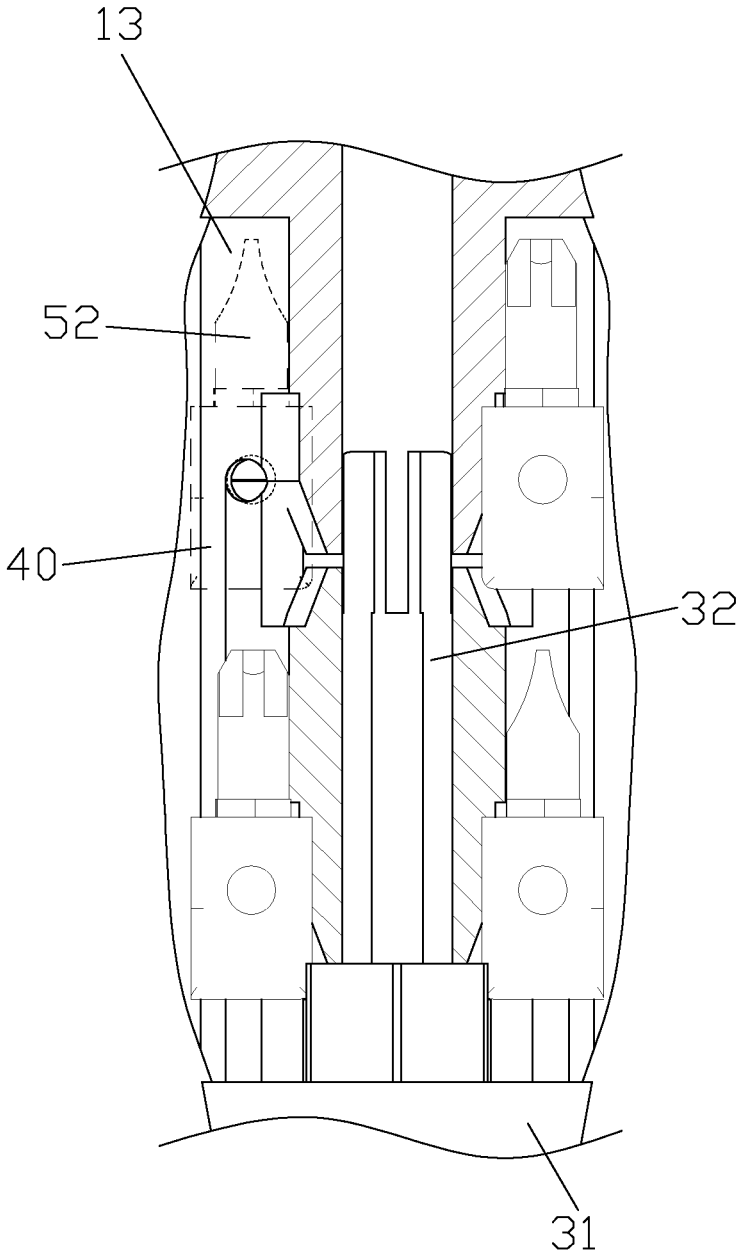
FIG. 4 is a cross-sectional view showing the operation of the screwdriver according to the preferred embodiment of the present invention.

Thereby, when the screwdriver 100 is not operated, as shown in FIGS. 3 and 4, the plurality of seats 40 are moved toward a number of storing positions individually so that the seats 40 and the number of bits 50 move in the chambers 13 of the front part 10 respectively to prevent the bits 50 from falling outward.

Figure 5:
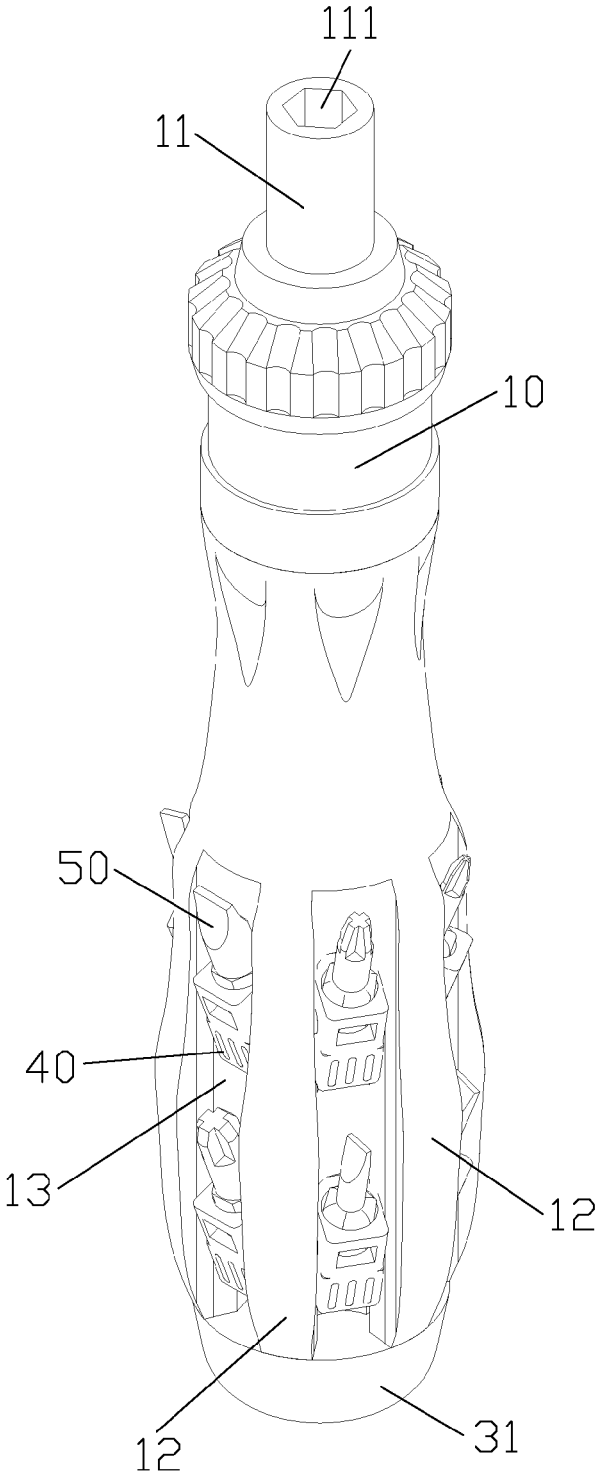
FIG. 5 is another perspective view showing the operation of the screwdriver according to the preferred embodiment of the present invention.
Figure 6:
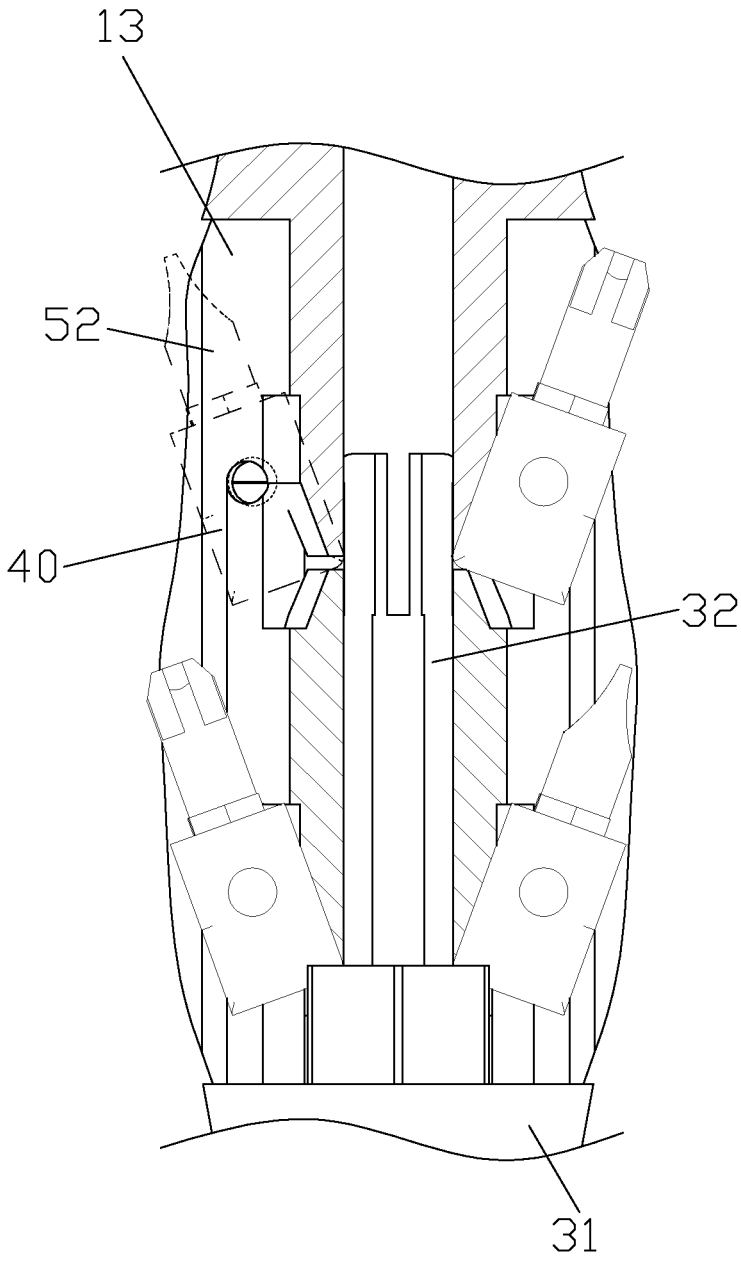
FIG. 6 is another cross sectional view showing the operation of the screwdriver according to the preferred embodiment of the present invention.
Figure 7:
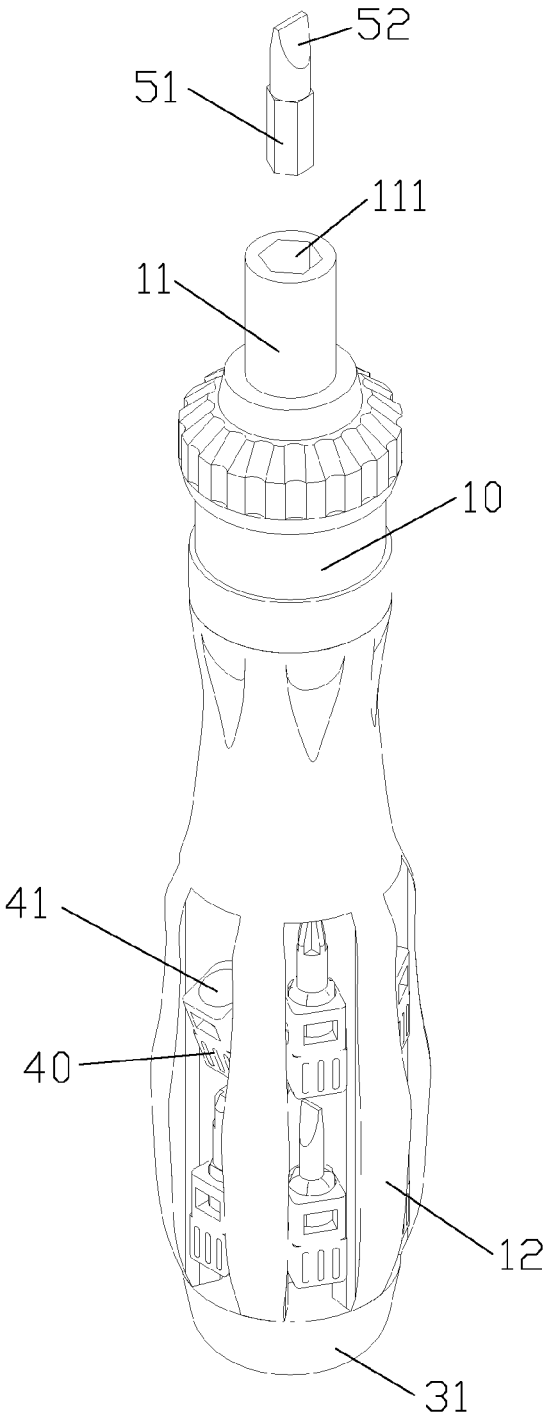
FIG. 7 is another perspective view showing the operation of the screwdriver according to the preferred embodiment of the present invention.

When the screwdriver 100 is operated, the seats 40 are moved toward the operating positions as illustrated in FIGS. 5 and 6 so that the acting segments 52 of the bits 50 of the seats 40 extend out of the chambers 1 of the front part 10, such that a desired bit 50 is distinguished and taken out of the seat 40, then the insertion 51 is inserted into the hole 111 of the front part 10 (as shown in FIG. 7) to rotate a predetermined screw.

While we have shown and described various embodiments in accordance with the present invention, it is clear to those skilled in the art that further embodiments may be made without departing from the scope of the present invention.

What is claimed is:

1. A screwdriver comprising:

a front part including a connector disposed on one end thereof and a number of ribs axially extending on another end thereof, between each two ribs being defined a chamber, and each rib includes a sliding projection extending outward from an inner side thereof;

a middle part including a central block and a plurality of extending wings extending around the central block, the central block including an orifice, each extending wing including a slot formed on an outer side thereof to slide the sliding projection;

a rear part including a cover, a shaft, and a plurality of pegs; a free end of the shaft of the rear part is inserted into the orifice of the middle part, and the pegs Contact with the ribs of the front part;

a plurality of seats axially connected between the two extending wings and the two pegs and located at the chamber of the front part, and each seat being moved between a storing position and an operating position by an external force;

a number of bits, each including one end to be inserted into the seat when the screwdriver is operated, the seat is moved toward an operating positions so that another end of the seats extends out of the chamber of the front part to take out a desired bit.

2. The screwdriver as claimed in claim 1, wherein the connector includes a hexagonal hole to fit the bits.

3. The screwdriver as claimed in claim 1, wherein the ribs of the front part are spaded apart from each other equally.

4. The screwdriver as claimed in claim 1, each rib includes a sliding projection extending outward from an inner side thereof, each extending wing includes a slot formed on an outer side thereof to slide the sliding projection so that the middle part is surrounded by the ribs.

5. The angle adjusting stand as claimed in claim 1, wherein the extending wings of the middle part integrally connected around the central block of the middle part.

6. The screwdriver as claimed in claim 1, wherein each extending wing includes two recesses arranged on two opposite sides thereof respectively; each peg includes two second cutouts fixed on two sides thereof individually; each seat includes two pillars arranged on two opposite sides thereof respectively so that the seat is axially coupled with the two recesses of the extending wing of the middle part and the two second cutouts of the peg of the rear part so that the seat is axially connected between the extending wing and the peg.

7. The screwdriver as claimed in claim 1, wherein the shaft includes a number of paws disposed on a free end thereof to retain with orifice of the central block.

8. The angle adjusting stand as claimed in claim 1, wherein the pegs integrally extend around the shaft of the front end of the cover.

9. The screwdriver as claimed in claim 1, wherein the rear part includes a rotary lid secured on a rear end of the cover and being capable of rotating relative to the cover.

10. The screwdriver as claimed in claim 1, wherein each seat includes a notch formed on one end thereof; each bit includes a hexagonal insertion disposed on one end thereof and an acting segment formed in different shapes and fixed on another end thereof, the insertion of the bit is inserted into the notch of the seat.

* * * * *